US009080730B2

(12) United States Patent
Popper et al.

(10) Patent No.: US 9,080,730 B2
(45) Date of Patent: Jul. 14, 2015

(54) COMBINATION FLASHLIGHT REFLECTOR AND LED CONVERSION MODULE

(71) Applicant: XGlow P/T, LLC, Scottsdale, AZ (US)

(72) Inventors: Richard S. Popper, Scottsdale, AZ (US); Jensen Jorgensen, Scottsdale, AZ (US)

(73) Assignee: XGLOW P/T, LLC, Scottsdale, AZ (US)

( * ) Notice: Subject to any disclaimer, the term of this patent is extended or adjusted under 35 U.S.C. 154(b) by 0 days.

(21) Appl. No.: 14/500,744

(22) Filed: Sep. 29, 2014

(65) Prior Publication Data

US 2015/0092398 A1 Apr. 2, 2015

Related U.S. Application Data

(60) Provisional application No. 61/885,323, filed on Oct. 1, 2013.

(51) Int. Cl.

| | |
|---|---|
| ***F21L 4/00*** | (2006.01) |
| ***F21K 99/00*** | (2010.01) |
| ***F21L 4/04*** | (2006.01) |
| ***F21V 7/00*** | (2006.01) |
| ***F21V 23/06*** | (2006.01) |
| ***F21V 7/20*** | (2006.01) |
| *F21Y 101/02* | (2006.01) |
| *F21W 131/30* | (2006.01) |

(52) U.S. Cl.

CPC ..... *F21K 9/1375* (2013.01); *F21K 9/90* (2013.01); *F21L 4/045* (2013.01); *F21V 7/0066* (2013.01); *F21V 7/20* (2013.01); *F21V 23/06* (2013.01); *F21W 2131/30* (2013.01); *F21Y 2101/02* (2013.01)

(58) Field of Classification Search

CPC ..... F21K 9/1375; F21L 4/045
USPC ..... 362/208
See application file for complete search history.

(56) References Cited

U.S. PATENT DOCUMENTS

| | | | | |
|---|---|---|---|---|
| 4,228,485 | A * | 10/1980 | Hubbard et al. | 362/191 |
| 2003/0123254 | A1 * | 7/2003 | Brass et al. | 362/231 |
| 2005/0007768 | A1 * | 1/2005 | Holder et al. | 362/157 |

* cited by examiner

*Primary Examiner* — David V Bruce
(74) *Attorney, Agent, or Firm* — Stephen C. Beuerle; Procopio Cory Hargreaves & Savitch LLP

(57) ABSTRACT

A combination reflector and LED conversion module for a non-LED flashlight includes a cup-shaped reflector including an interior with a reflective surface, an exterior, an open end, and an end opposite the open end; and one or more LEDs carried by the cup-shaped reflector adjacent the end opposite the open end. The combination reflector and LED conversion module replaces an existing non-LED bulb and reflector of a non-LED flashlight to convert the non-LED flashlight to a LED flashlight.

15 Claims, 25 Drawing Sheets

COMBINATION FLASHLIGHT REFLECTOR AND LED CONVERSION MODULE

CROSS REFERENCE TO RELATED APPLICATION

This application claims priority to U.S. Provisional Patent Application 61/885,323, filed Oct. 1, 2013, which is incorporated by reference here.

FIELD OF THE INVENTION

The present invention relates to, in general, to replacement reflectors for flashlights, and, in particular, to replacement combination reflectors and LED conversion modules for flashlights.

BACKGROUND OF THE INVENTION

Over the years many consumers have bought flashlights that do not use LED chips for various reasons (e.g., flashlights purchased before LED's were released, lower price, etc.).

However, LED flashlights offer a brighter light, lower energy consumption, and greater durability. LED flashlights can be quite expensive and consumers that already own a non-LED flashlights might not see the reason for investing money into a new more expensive LED light, even if they would like to have the advantages that the LED flashlights offer.

LED conversion kits have been proposed in the past, but one of the problems with these LED conversion kits is that they do not replace the reflector in the LED flashlight. As a result, the beam emitted from the flashlight is not optimized. Additional problems with LED conversion kits proposed in the past is that they are often very highly priced, are very low powered, sometimes offers less light than the bulbs they replace, do not fit seamlessly into the existing flashlight, and/or require the user to modify existing parts inside the flashlight to be able to fit the new LED module.

Therefore, a need exists for a combination reflector and LED conversion module for a flashlight that will fit seamlessly into non-LED flashlights and replace the existing non-LED bulb. In doing so, a conventional non-LED flashlight is converted into a LED flashlight offering all the advantages of a LED, but at a lower cost and without the need to fully replace an existing flashlight.

SUMMARY OF THE INVENTION

Accordingly, an aspect of the invention involves a combination reflector and LED conversion module that replaces the existing non-LED bulb of a non-LED flashlight to convert the non-LED flashlight to a LED flashlight. The reflector configuration is customized for each flashlight model to both optimize light emission beam from the LED(s) and heat transfer away from the LED(s). The reflector includes an exterior cooling mechanism for transferring heat away from the LED (s). Cooling fins and grooves of the exterior cooling mechanism create an efficient heat sink that transfers heat from the reflector to a flashlight outer shell, allowing heat to escape to the outside and preventing the LED(s) from overheating and failing.

Another aspect of the invention involves a combination reflector and LED conversion module for a non-LED flashlight. The combination reflector and LED conversion module includes a cup-shaped reflector including an interior with a reflective surface, an exterior, an open end, and an end opposite the open end; one or more LEDs carried by the cup-shaped reflector adjacent the end opposite the open end; and a contact electrically coupled to the one or more LEDs. The combination reflector and LED conversion module replaces an existing non-LED bulb and reflector of a non-LED flashlight to convert the non-LED flashlight to a LED flashlight.

One or more implementations of the combination reflector and LED conversion module described immediately above includes one or more of the following: the exterior of the reflector includes an exterior cooling mechanism for transferring heat away from the one or more LEDs; the exterior cooling mechanism includes cooling fins that transfer heat away from the reflector; the exterior cooling fins circumferentially radiate outwardly from the exterior of the reflector; the combination reflector and LED conversion module of claim 3 further includes grooves disposed between the exterior cooling fins; the combination reflector and LED conversion module includes a LED base adjacent the end opposite the open end and the one or more LEDs carried by the LED base; the combination reflector and LED conversion module includes a foot that the contact is disposed at least partially within; a method of converting a non-LED flashlight to a LED flashlight includes providing a non-LED flashlight including a non-LED bulb and reflector; removing the non-LED bulb and reflector from the non-LED flashlight; replacing the non-LED bulb and reflector with the combination reflector and LED conversion module so as to convert the non-LED flashlight to a LED flashlight; the exterior of the reflector includes an exterior cooling mechanism and the method further includes transferring heat away from the one or more LEDs with the exterior cooling mechanism; and/or the exterior cooling mechanism includes cooling fins that transfer heat away from the reflector and the method further includes transferring heat away from the one or more LEDs with the cooling fins.

Another aspect of the invention involves a combination reflector and LED conversion module for a non-LED flashlight includes a cup-shaped reflector including an interior with a reflective surface, an exterior, an open end, and an end opposite the open end; and one or more LEDs carried by the cup-shaped reflector adjacent the end opposite the open end. The combination reflector and LED conversion module replaces an existing non-LED bulb and reflector of a non-LED flashlight to convert the non-LED flashlight to a LED flashlight.

One or more implementations of the combination reflector and LED conversion module described immediately above includes one or more of the following: a separate connector to couple the one or more LEDs of the combination reflector and LED conversion module to an energy source of the flashlight; the separate connector includes a circular disc shape; the separate connector includes an upper circular surface with a ring-shaped contact; the separate connector includes a lower circular surface with a pair of terminals; the combination reflector and LED conversion module includes a receiving section that fits over the separate connector; the exterior of the reflector includes an exterior cooling mechanism for transferring heat away from the one or more LEDs; the exterior cooling mechanism includes cooling fins that transfer heat away from the reflector; the exterior cooling fins circumferentially radiate outwardly from the exterior of the reflector; and/or the combination reflector and LED conversion module includes grooves disposed between the exterior cooling fins.

A further aspect of the invention involves a method of converting a non-LED flashlight to a LED flashlight, comprising providing a non-LED flashlight including a non-LED bulb and reflector; removing the non-LED bulb and reflector from the non-LED flashlight; replacing the non-LED bulb and reflector with the combination reflector and LED conversion module of the aspect of the invention described immediately above so as to convert the non-LED flashlight to a LED flashlight.

One or more implementations of the method of converting a non-LED flashlight to a LED flashlight described immediately above includes one or more of the following: the exterior of the reflector includes an exterior cooling mechanism, and the method further includes transferring heat away from the one or more LEDs with the exterior cooling mechanism; the exterior cooling mechanism includes cooling fins that transfer heat away from the reflector, and the method further includes transferring heat away from the one or more LEDs with the cooling fins; a separate connector to couple the one or more LEDs of the combination reflector and LED conversion module to an energy source of the flashlight and the combination reflector and LED conversion module including a receiving section that fits over the separate connector, and the method further includes coupling the separate connector to the energy source of the flashlight, fitting the receiving section over the separate connector, and coupling the one or more LEDs to the separate connector; and/or the non-LED flashlight includes an end cap that screws onto and off of a head of the non-LED flashlight, and the method further includes unscrewing the end cap off of the head of the non-LED flashlight prior to removing the non-LED bulb and reflector from the non-LED flashlight and screwing the end cap onto the head of the LED flashlight after replacing the non-LED bulb and reflector with the combination reflector and LED conversion module.

DETAILED DESCRIPTION OF THE PREFERRED EMBODIMENTS

Figure 1:
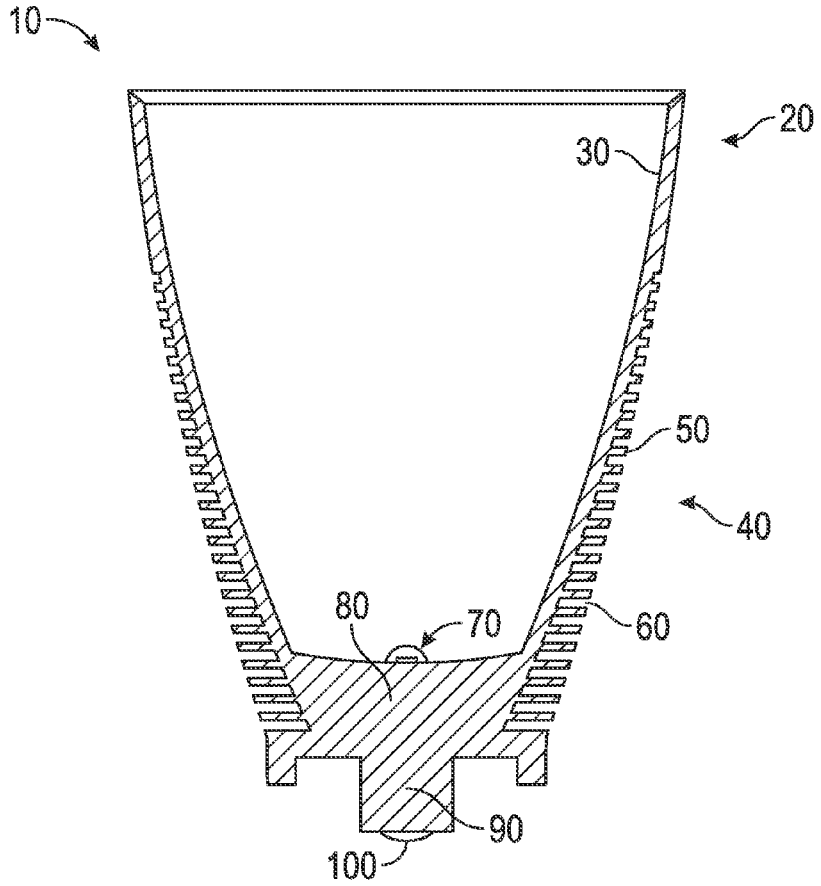
FIG. 1 is a cross sectional view of a combination reflector and LED conversion module in accordance with an embodiment of the invention.
Figure 2:
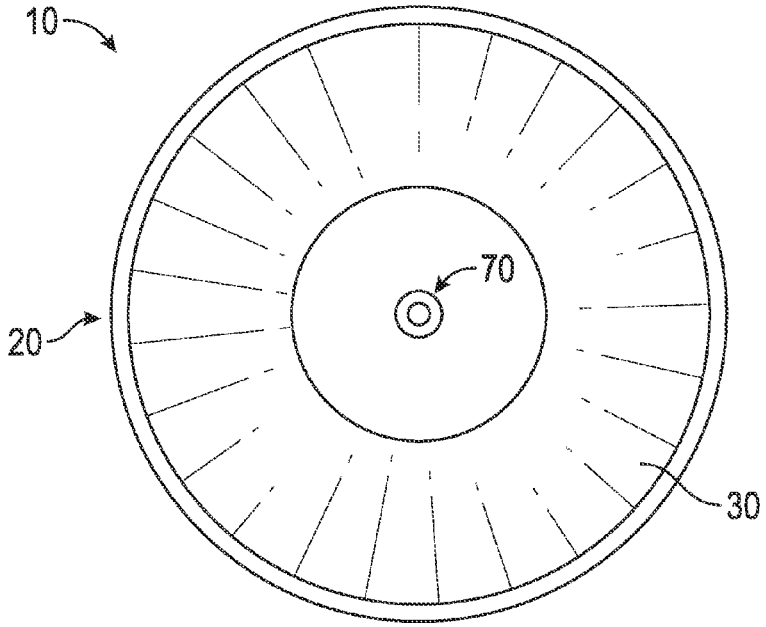
FIG. 2 is a top plan view of the combination reflector and LED conversion module.

With reference to FIGS. 1 and 2, an embodiment of a combination reflector and LED conversion module 10 that replaces the existing non-LED bulb of a non-LED flashlight to convert the non-LED flashlight to a LED flashlight will be described.

The combination reflector and LED conversion module 10 includes a cup-shaped reflector 20 with an interior reflective surface 30 and an exterior cooling mechanism 40. The interior reflective surface 30 includes a highly efficient reflective coating designed specifically for the LED built into the module 10 to offer most optimal light beam. The exterior cooling mechanism includes outwardly circumferentially radiating cooling fins 50 and grooves 60 disposed between the cooling fins 50.

One or more light emitting diode (LED(s)) and printed circuit board (PCB(s)) 70 are fixed in a LED base/housing 80 of the module 10. The LED base/housing 80 holds the LED and PCB in place, assists with heat dispensation/transfer, and acts as a negative terminal. The LED(s) and PCB(s) are created and programmed to make use of the flashlight's existing circuitry and functions. The PCB(s) may be configured to deliver the maximum rated current to the LED(s) for emitting the brightest light. The shape of the LED base 80 varies with the shape and size of the cavity inside the flashlight the module 10 is designed to fit. The reflector 20 extends upwardly from the base 80. The cooling fins 50 also radiate outwardly circumferentially from the LED base 80 so as to contact the inner surface of the flashlight head to maximize heat dispensation/transfer. The grooves 60 increase the surface area of the cooling fins 50 to maximize heat dispensation/transfer. Providing the exterior cooling mechanism 40 on the exterior of both the reflector 20 and the base 80 enlarges the area through which heat can be conducted more efficiently.

A foot or bulb housing fitting 90 extends downwardly from the LED base 80 and includes a contact or positive terminal 100 that extends downwardly from the foot 90 for electrically coupling the module 10 with one or more batteries. The foot 90 is the same size as the base of the bulb it replaces (i.e., fits the existing incandescent bulb housing), allowing the module 10 to make use of the existing energy source, without any modifications to the flashlight, and keeps the module 10 in place.

Both the reflector 20 and the base 80 are preferably produced from solid conductive materials, preferably aluminum, but, in alternative embodiments, other materials are used. The reflector 20 and the base 80 are preferably either machined to or casted into the required shape. The overall shape of the module 10 varies, depending on the flashlight model that the module 10 is made to fit in, so that the module fits tightly inside the flashlight. A tight fit inside the flashlight is important for increasing the heat conductivity of the module, optimizing the light beam emission, and reducing the chances of flashlight malfunction or other problems during normal operation of the flashlight.

Customizing the shape of the reflector 20 for each flashlight model optimizes the light emission beam from the LED 70. In current existing LED conversion kits, the existing reflector of the flashlight is used to create the beam. These reflectors are not as efficient as the reflector 20 because these reflectors are not made to reflect light from the LED(s). Light beam profiles from LED chips and incandescent or halogen lamps are different and require reflectors that are specifically made to focus these beams. As a result, there is no need to alter the existing reflector or purchase a new reflector with the module 10.

The reflector 20 transfers excessive heat away from the LED(s), and the cooling fins 50 and the grooves 60 create an efficient heat sink that can move heat away from the LED(s). The shape and size of the cooling fins 50 and the grooves 60 vary with the shape and size of the flashlight head the module 10 fits into. By making sure that the reflector 20 fits tightly inside the head of the flashlight, the cooling fins 50 are in constant contact with the flashlight outer shell, allowing heat to escape to the outside. The design of the reflector 20 and cooling fins 50/grooves 60 optimizes the amount of heat transfer away from the LED(s), preventing the LED(s) 70 from overheating and failing.

The reflector 20 and LED base 80 can be manufactured or molded as one single piece or as separate pieces that are fitted together during the manufacturing process, based on requirements of the particular flashlight the module 10 will fit into.

Figure 3:
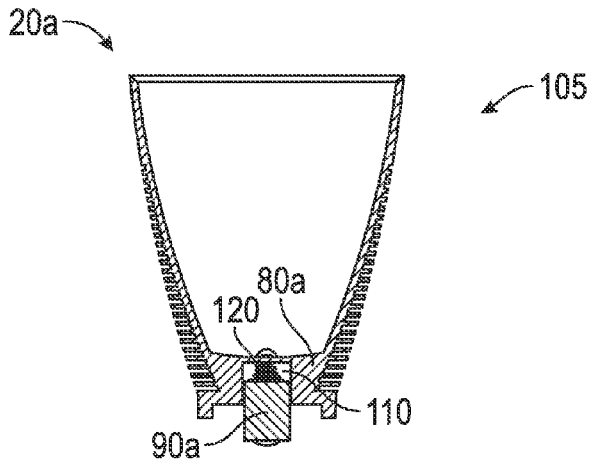
FIG. 3 is a cross sectional view of another embodiment of a combination reflector and LED conversion module.

With reference to FIG. 3, another embodiment of a combination reflector and LED conversion module 105 will be described. Like elements to those shown and described with respect to combination reflector and LED conversion module 10 are identified with like reference numbers and an "a" suffix, and the description of these elements is incorporated herein. The combination reflector and LED conversion module 105 includes a LED base 80*a* and a foot 90*a* made so that the two pieces 80*a*, 90*a* move independently from each other (e.g., foot 90*a* slidably received in a recess 110 of base 80*a*). Preferably, the two pieces 80*a*, 90*a* will be spring loaded with spring 120 there between, allowing the LED base 80*a* and reflector 20*a* to move up and down on top of the foot 90*a*, without losing contact with the battery. This embodiment might be desirable for use with lights that have the ability to vary the light beam output by twisting the flashlight head.

Figure 4:
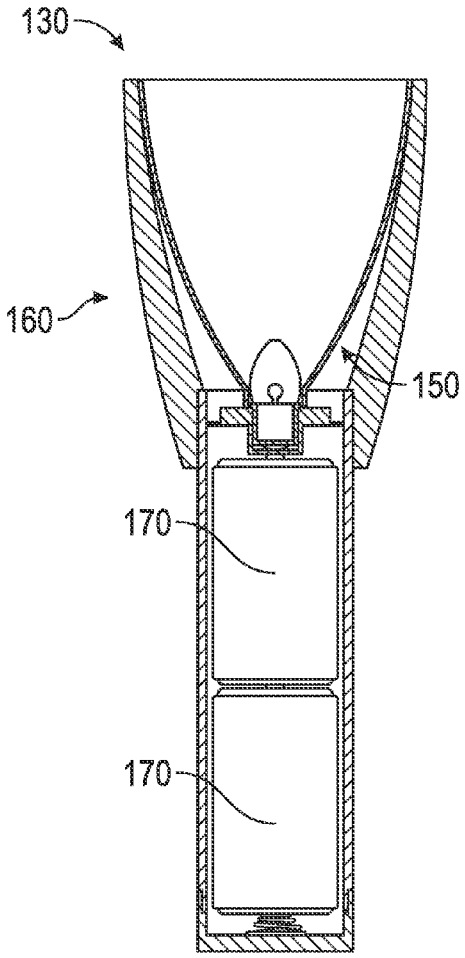
FIG. 4 is a cross sectional view of a non-LED flashlight.
Figure 5:
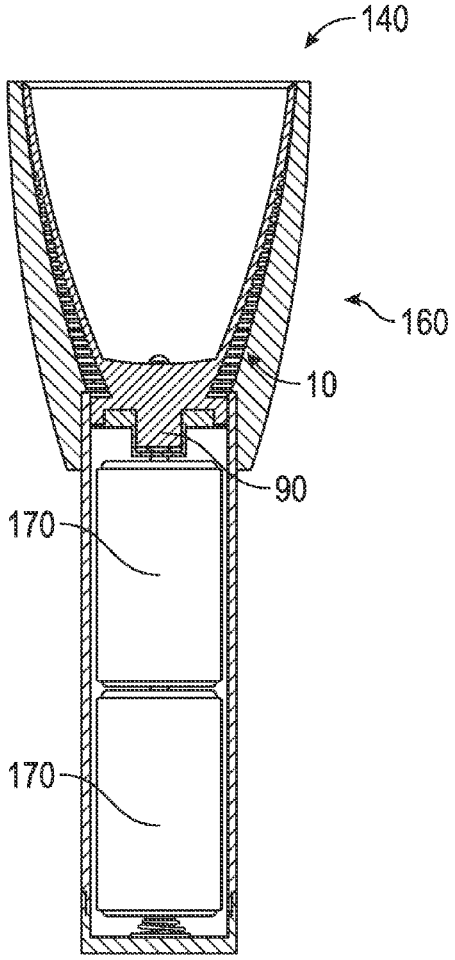
FIG. 5 is a cross sectional view of an embodiment of a converted LED flashlight including the combination reflector and LED conversion module of FIGS. 1 and 2.
Figure 6:
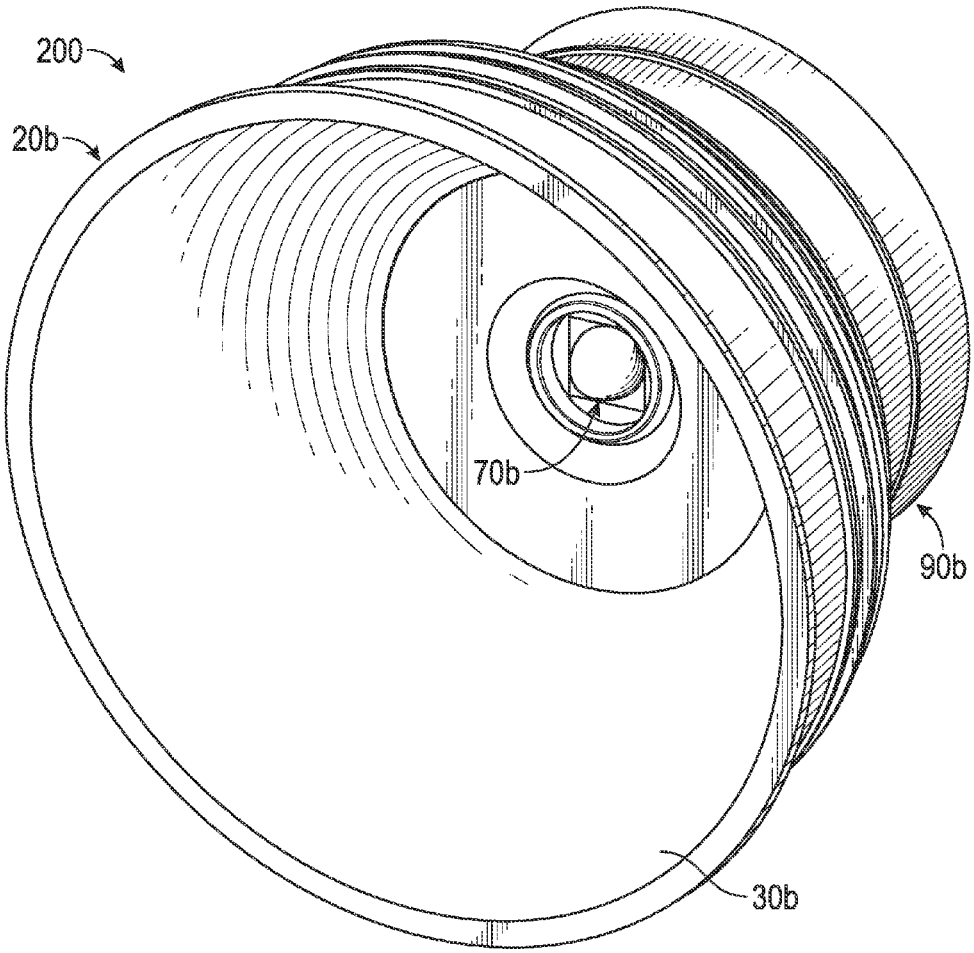
FIG. 6 is a front perspective view of another embodiment of a combination reflector and LED conversion module.
Figure 7:
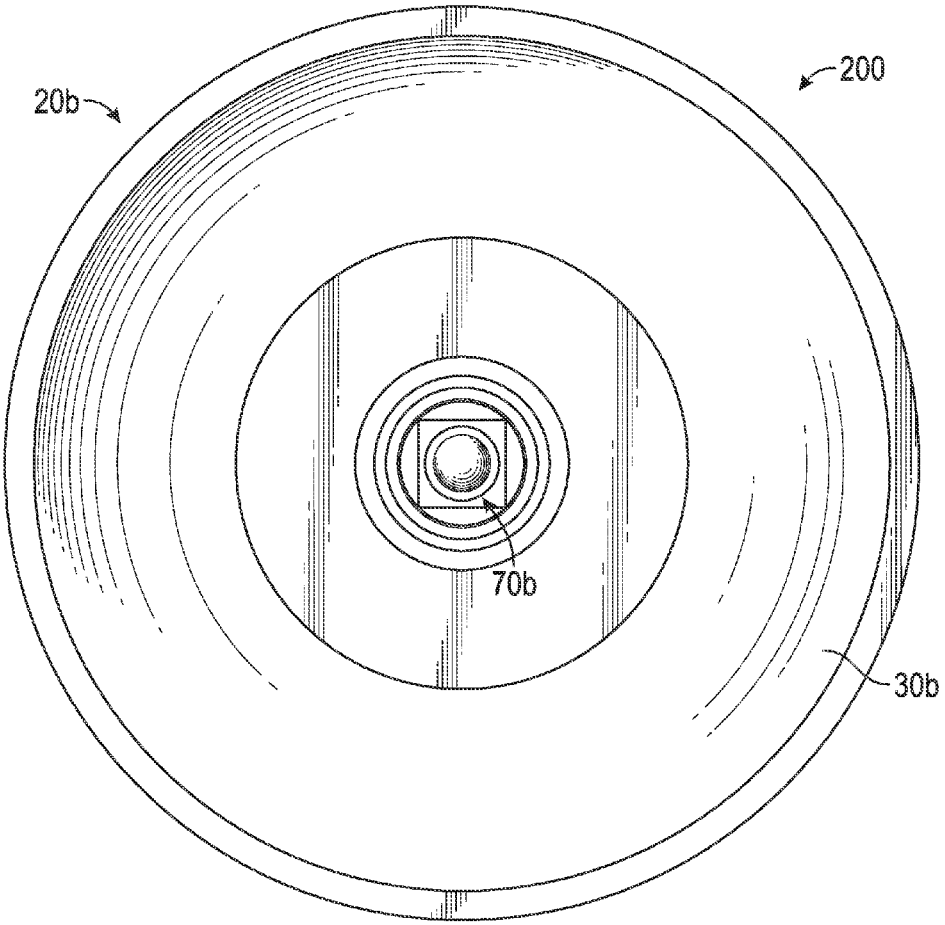
FIG. 7 is a front elevational view of the combination reflector and LED conversion module of FIG. 6.
Figure 8:
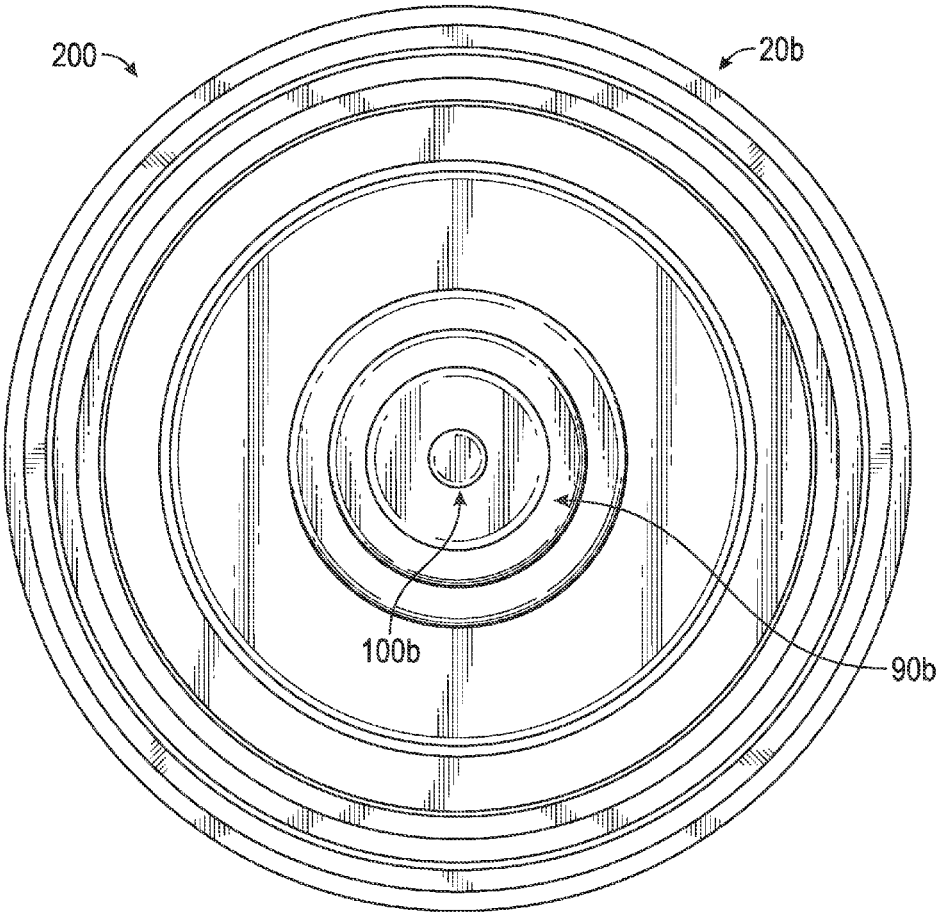
FIG. 8 is a rear elevational view of the combination reflector and LED conversion module of FIG. 6.
Figure 9:
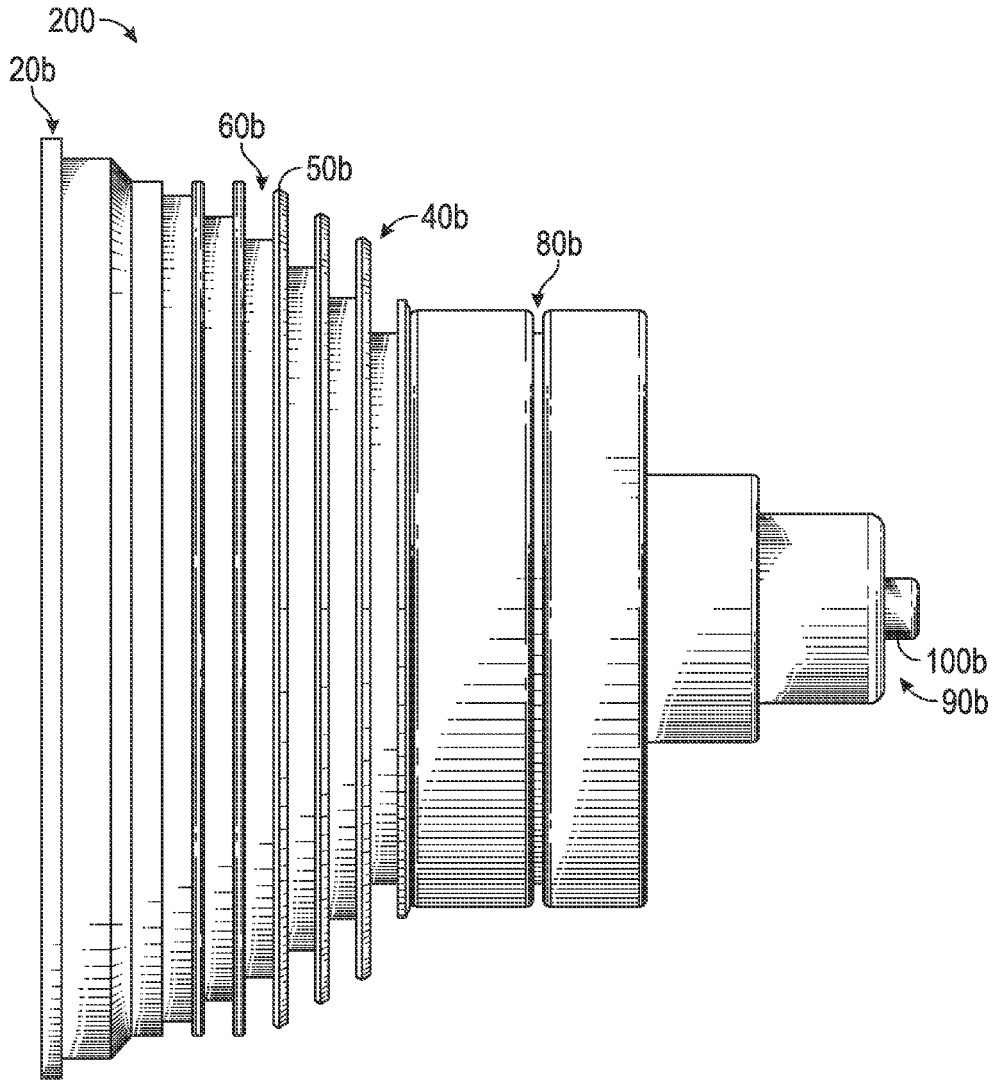
FIG. 9 is a right side elevational view of the combination reflector and LED conversion module of FIG. 6.
Figure 10:
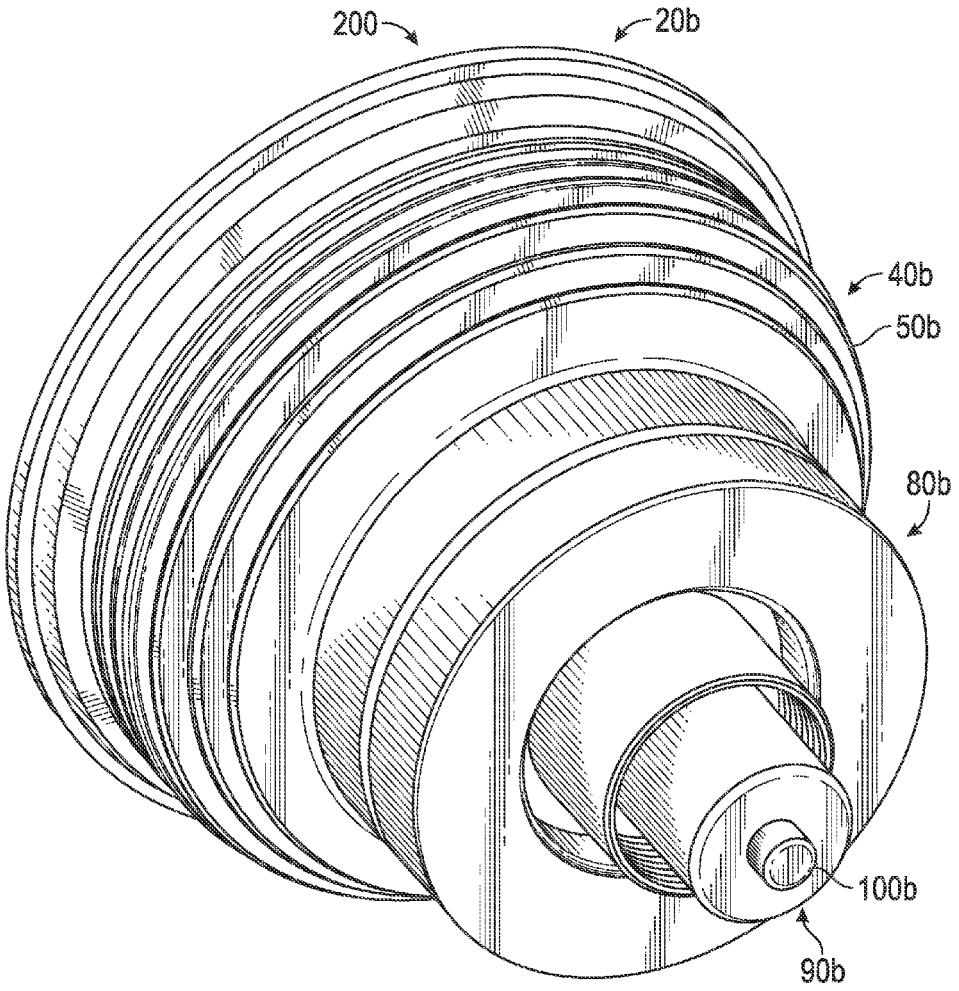
FIG. 10 is a rear perspective view of the combination reflector and LED conversion module of FIG. 6.
Figure 11:
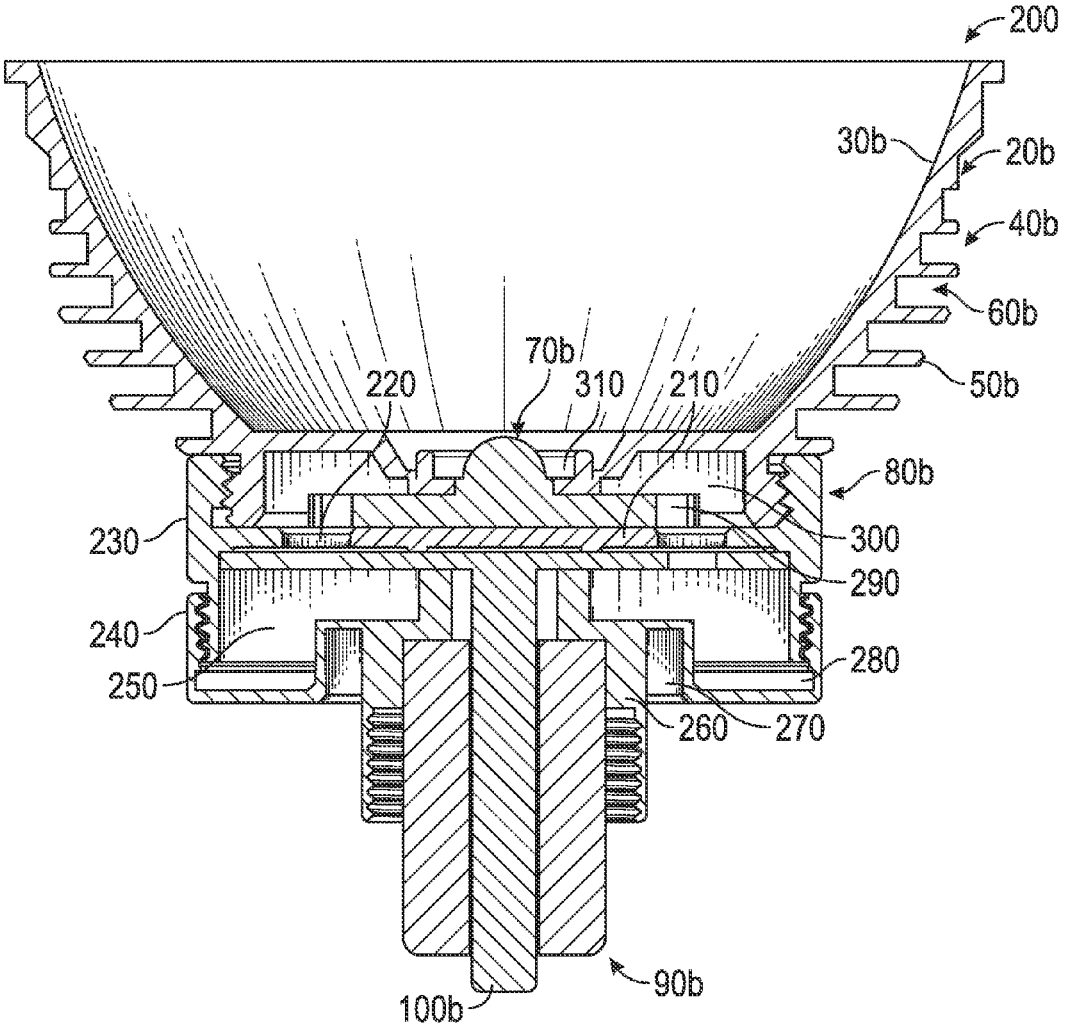
FIG. 11 is a cross-sectional view of the combination reflector and LED conversion module of FIG. 6.
Figure 12:
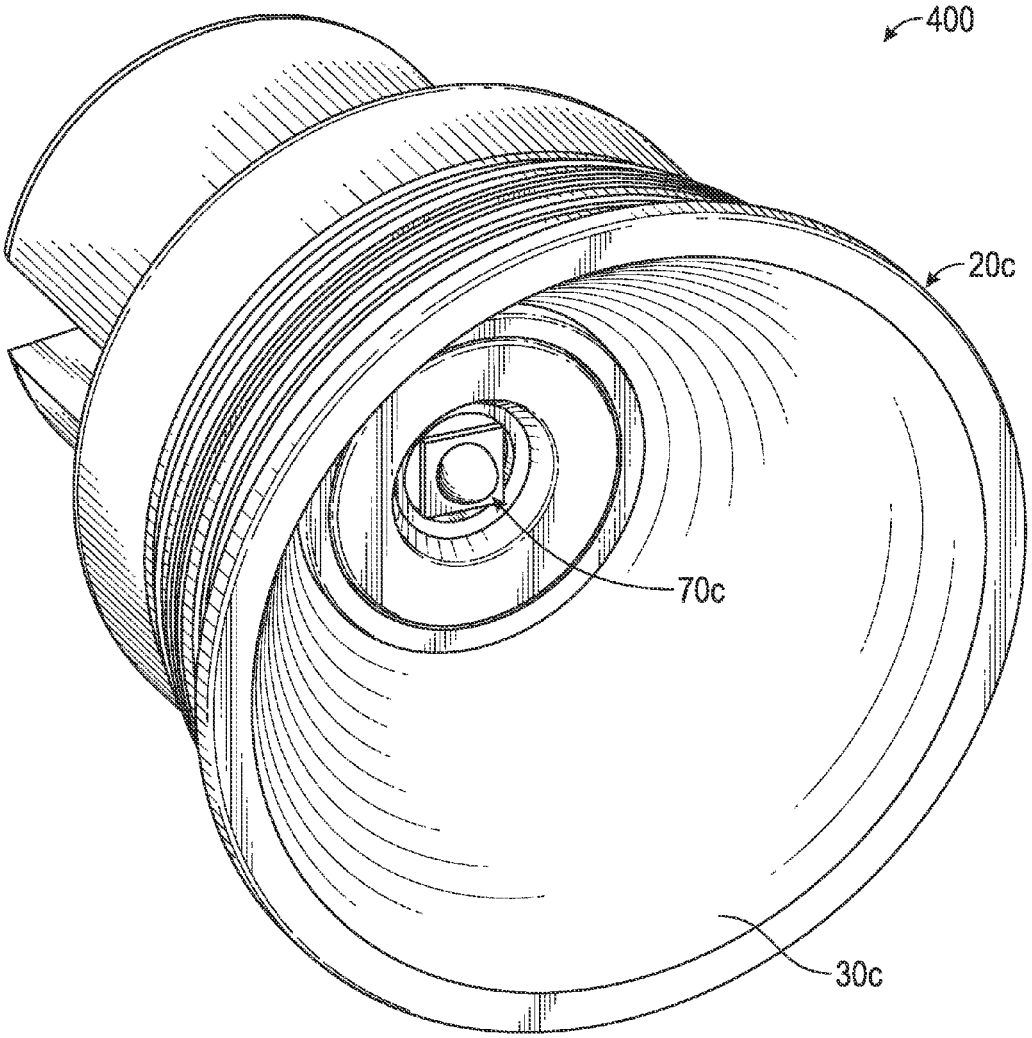
FIG. 12 is a front perspective view of a further embodiment of a combination reflector and LED conversion module.
Figure 13:
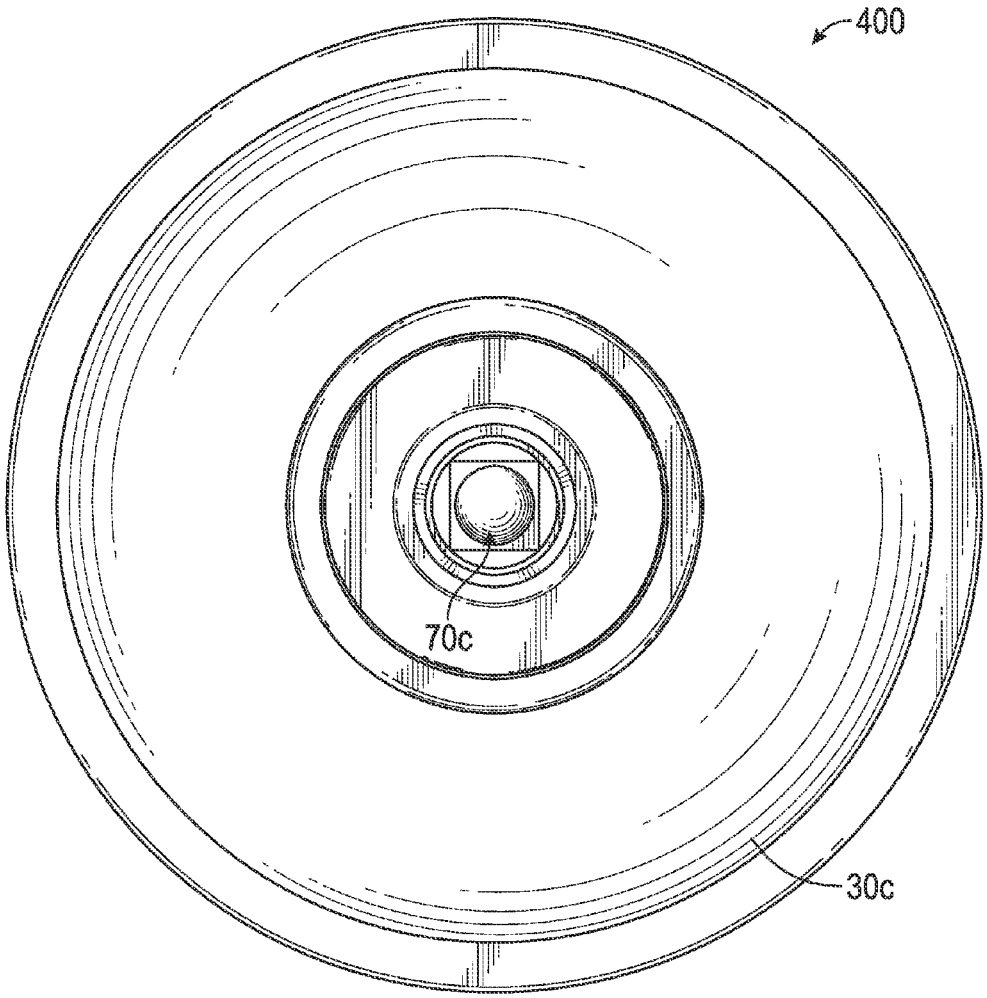
FIG. 13 is a front elevational view of the combination reflector and LED conversion module of FIG. 12.
Figure 14:
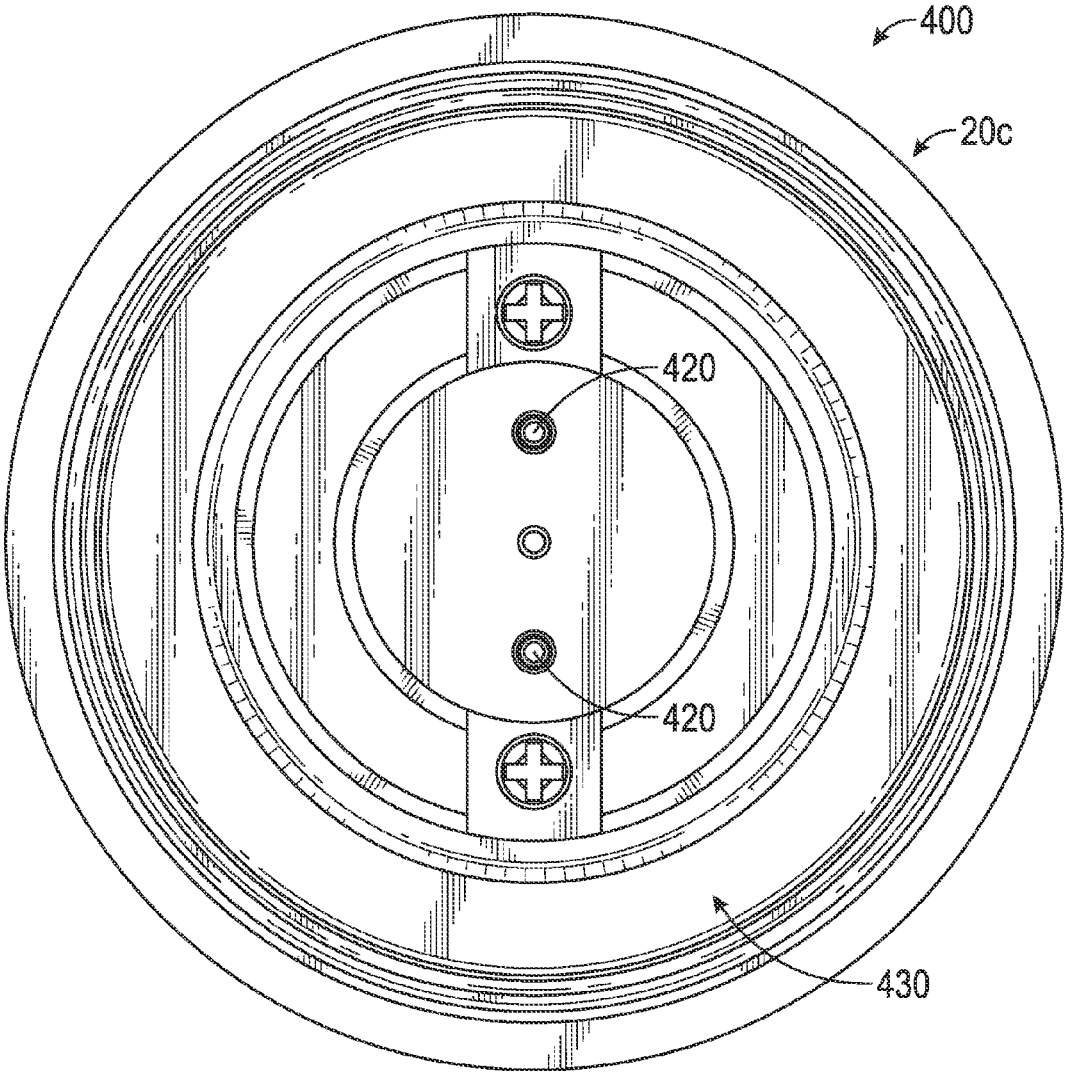
FIG. 14 is a rear elevational view of the combination reflector and LED conversion module of FIG. 12.
Figure 15:
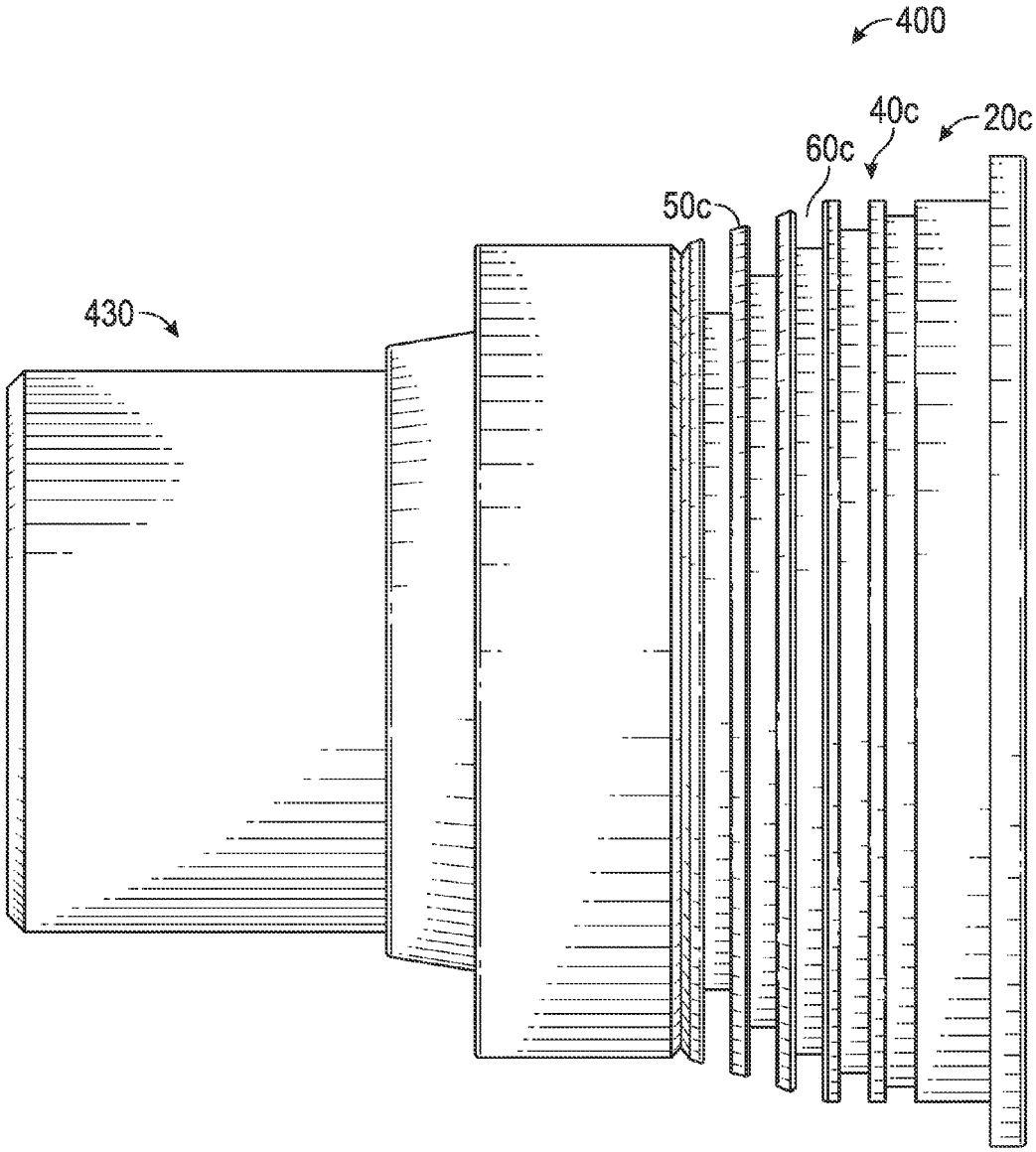
FIG. 15 is a left side elevational view of the combination reflector and LED conversion module of FIG. 12.
Figure 16:
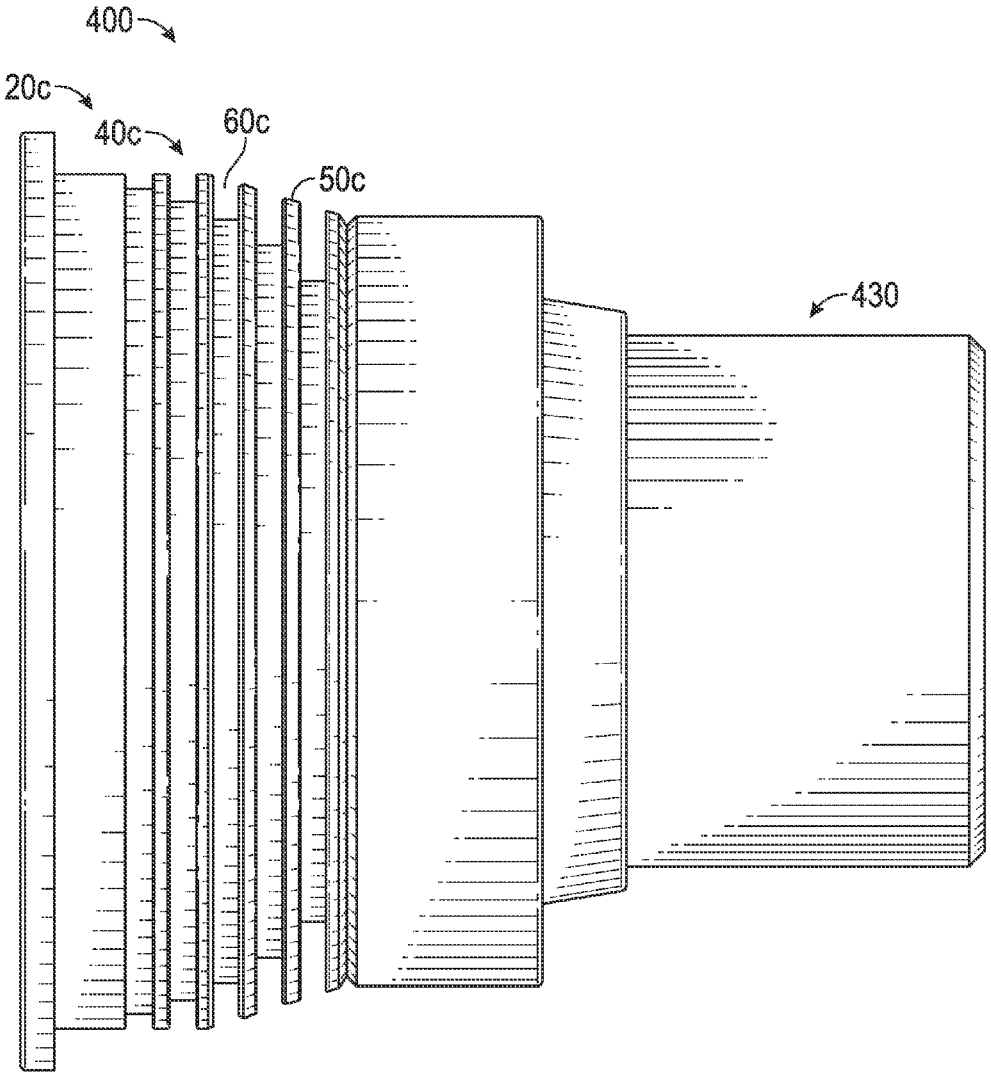
FIG. 16 is a right side elevational view of the combination reflector and LED conversion module of FIG. 12.
Figure 17:
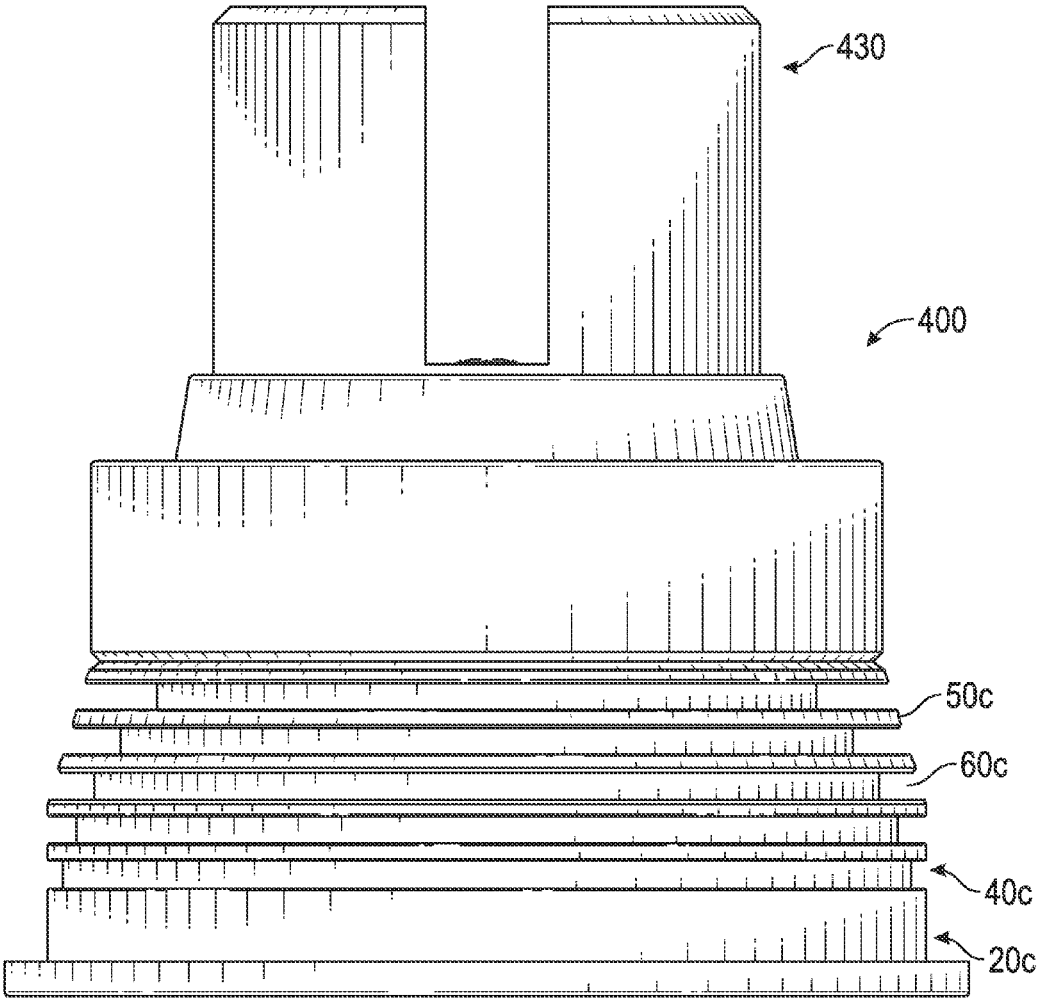
FIG. 17 is a top plan view of the combination reflector and LED conversion module of FIG. 12.
Figure 18:
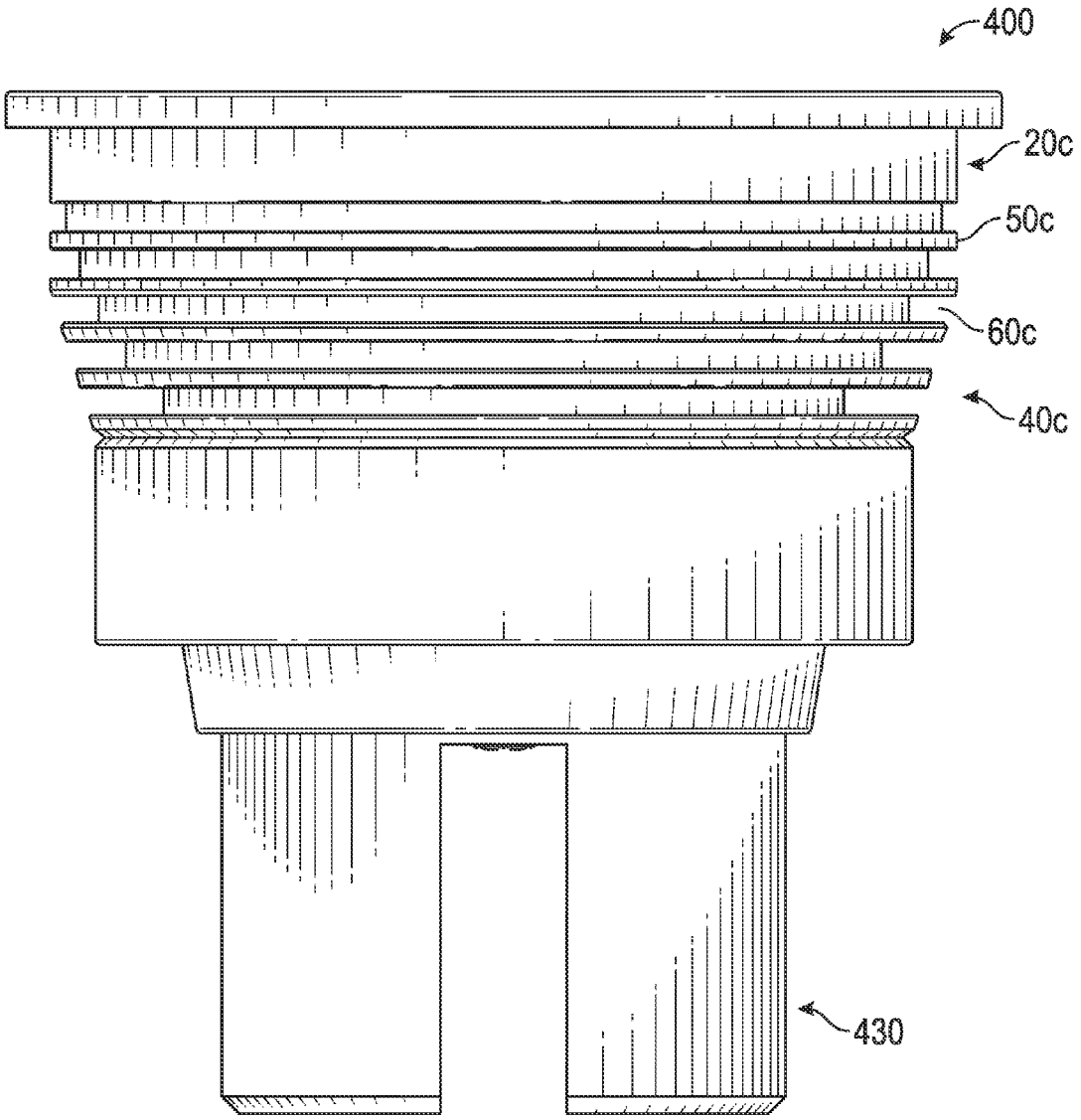
FIG. 18 is a bottom plan view of the combination reflector and LED conversion module taken along line 18-18 of FIG. 15.
Figure 19:
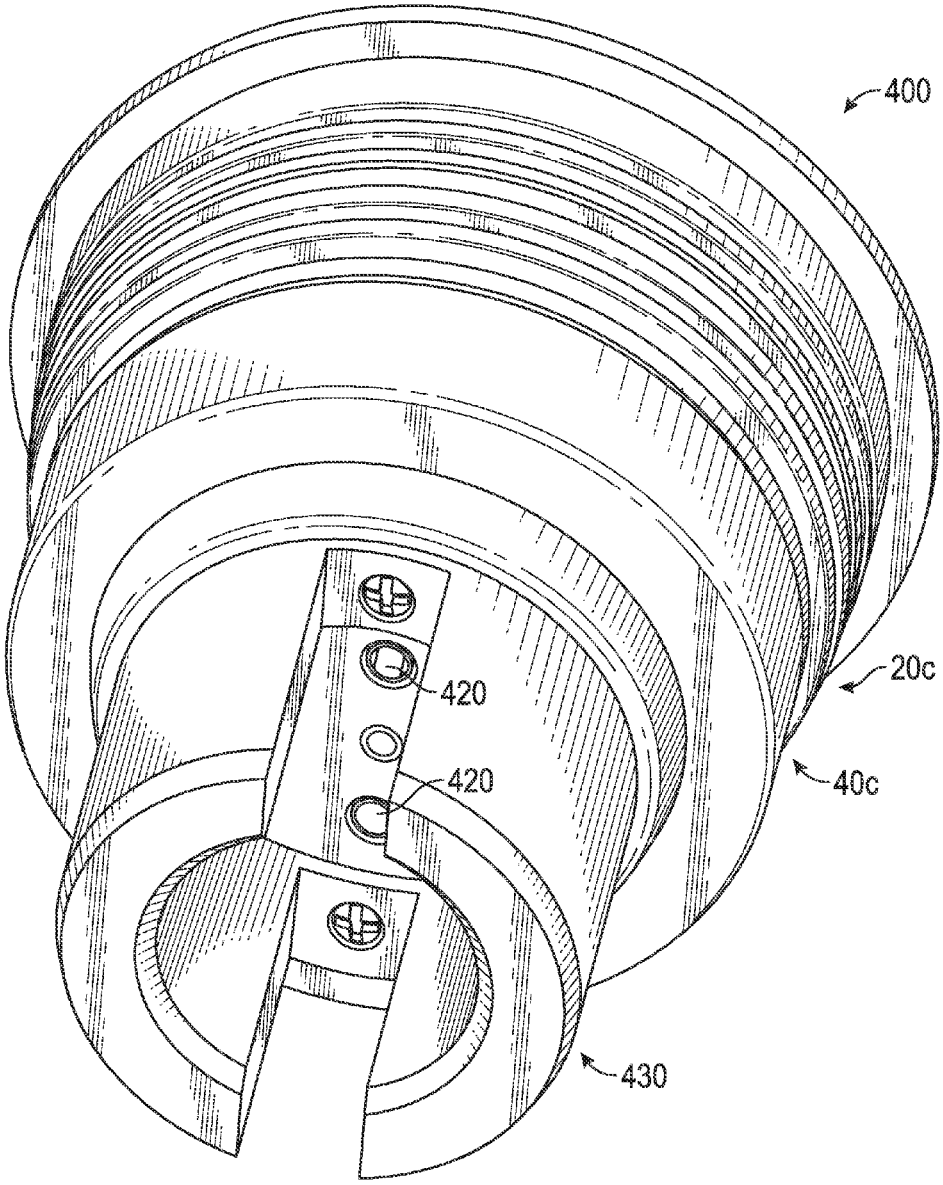
FIG. 19 is a rear perspective view of the combination reflector and LED conversion module of FIG. 12.

With reference to FIGS. 4 and 5, to convert a non-LED flashlight 130 (FIG. 4) to a LED flashlight 140 (FIG. 5), an existing non-LED bulb/reflector/base 150 of the non-LED flashlight 130 is removed from a head 160 of the flashlight 130 and is replaced with the combination reflector and LED conversion module 10 in the head 160 of the flashlight 140. Because the foot 90 is the same size as the base of the bulb it replaces, the module 10 makes use of the existing energy source (e.g., one or more single-use batteries, one or more rechargeable batteries) 170, without any modifications to the flashlight.

With reference to FIGS. 6-11, another embodiment of a combination reflector and LED conversion module 200 is shown. Like elements to those shown and described with respect to combination reflector and LED conversion module 10 are identified with like reference numbers and a "b" suffix, and the description of these elements is incorporated herein. The combination reflector and LED conversion module 200 includes a LED mounting seat 210, holes 220 (for screws holding mounting seat 200 in place), an upper part 230 (of LED base 80*b*), a lower part 240 (of LED base 80*b*, screws onto upper part 230), a cavity 250 (inside LED base 80*b*), a bulb fitting guide 260 (made to be same size of existing incandescent bulb, holding the module 200 in place, works in cooperation with foot 90*b*, configuration/size depends on overall flashlight design and might not be required in some models), a cavity 270 (where incandescent socket of flashlight fits into, some flashlights may require cavity 270, some flashlights may not require cavity 270, depends on overall flashlight design), floor 280 (of LED base 80*b*), a cavity 290 (inside of LED base 80*b*), a cavity 300, and a lip 310 (inside reflector 20*b*, holds the reflector 20*b* in place around the LED 70*b*, lip 310 may or may not be included in alternative embodiments of module 200).

Figure 20:
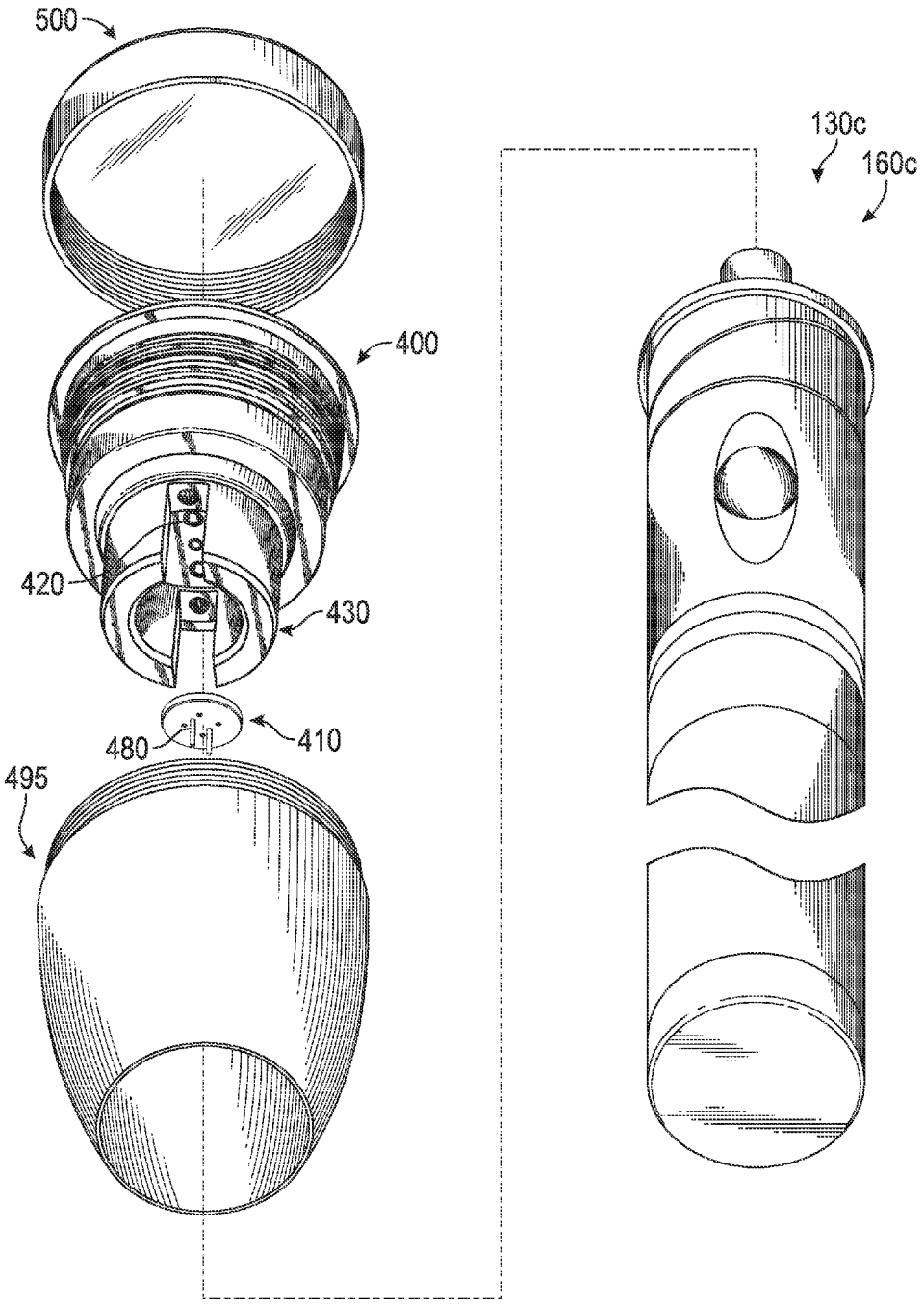
FIG. 20 is an exploded perspective view of a flashlight including the combination reflector and LED conversion module of FIG. 12 and a circular disc-shaped connector.
Figure 21:
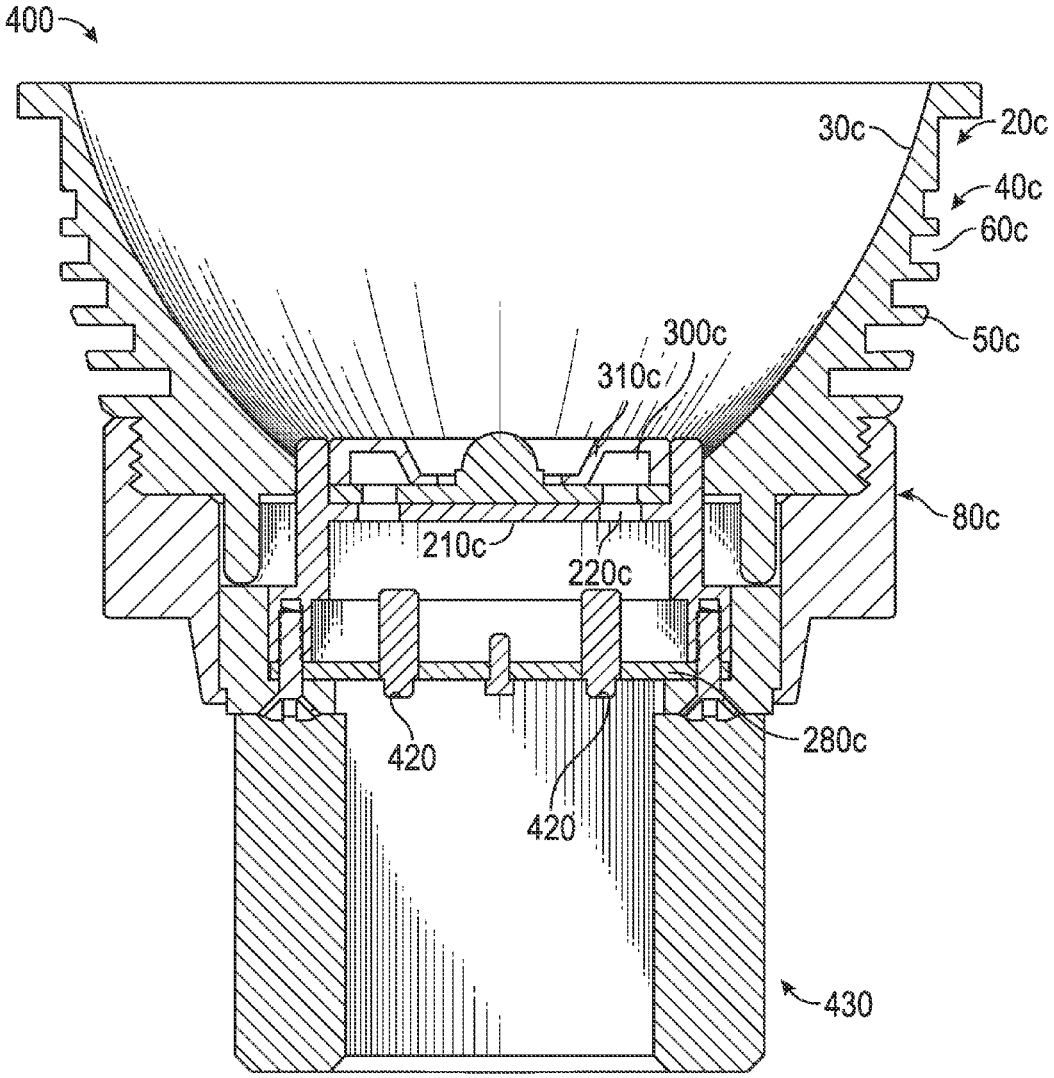
FIG. 21 is a cross-sectional view of the combination reflector and LED conversion module of FIG. 12.
Figure 22:
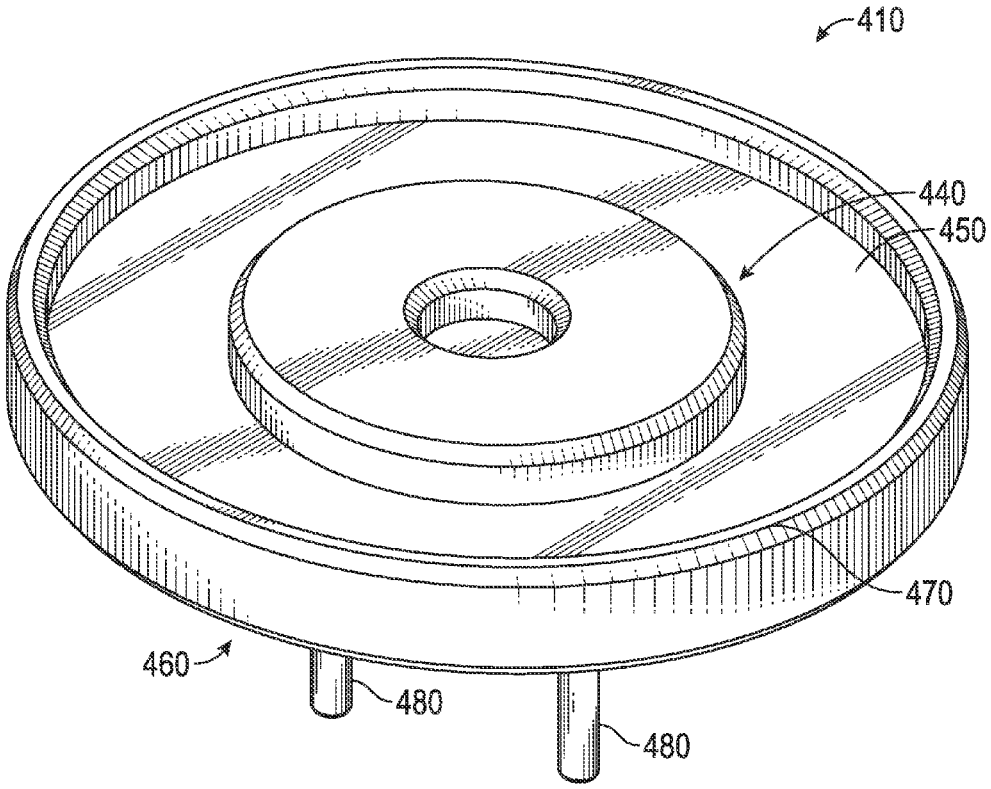
FIG. 22 is a front perspective view of the circular disc-shaped connector of FIG. 20.
Figure 23:
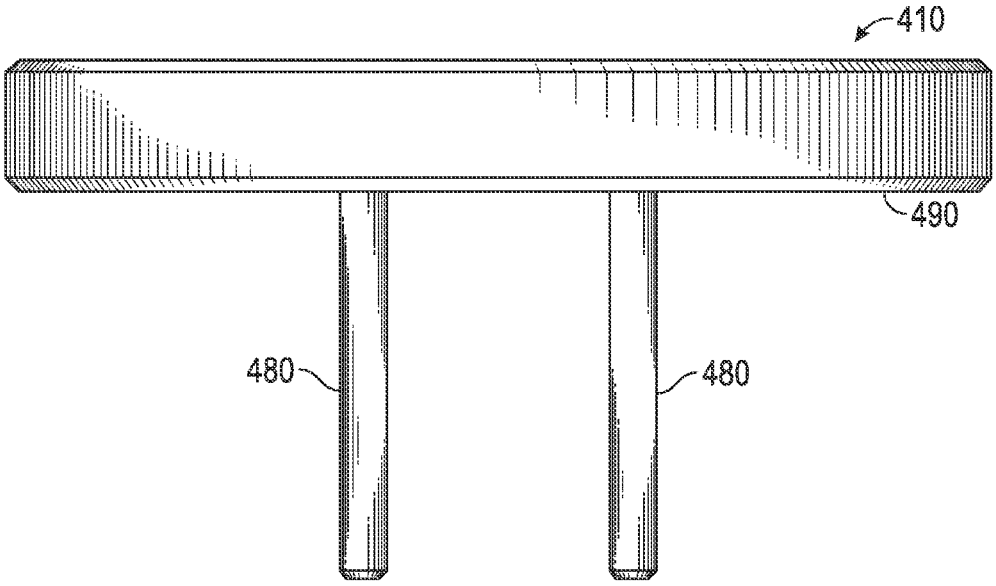
FIG. 23 is a front elevational view of the circular disc-shaped connector of FIG. 22.
Figure 24:
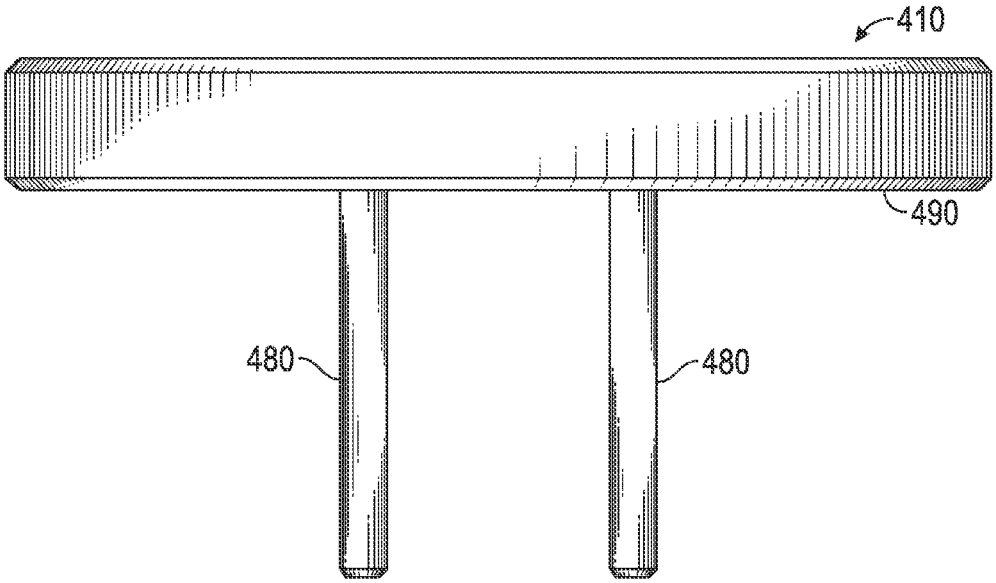
FIG. 24 is a rear elevational view of the circular disc-shaped connector of FIG. 22.
Figure 25:
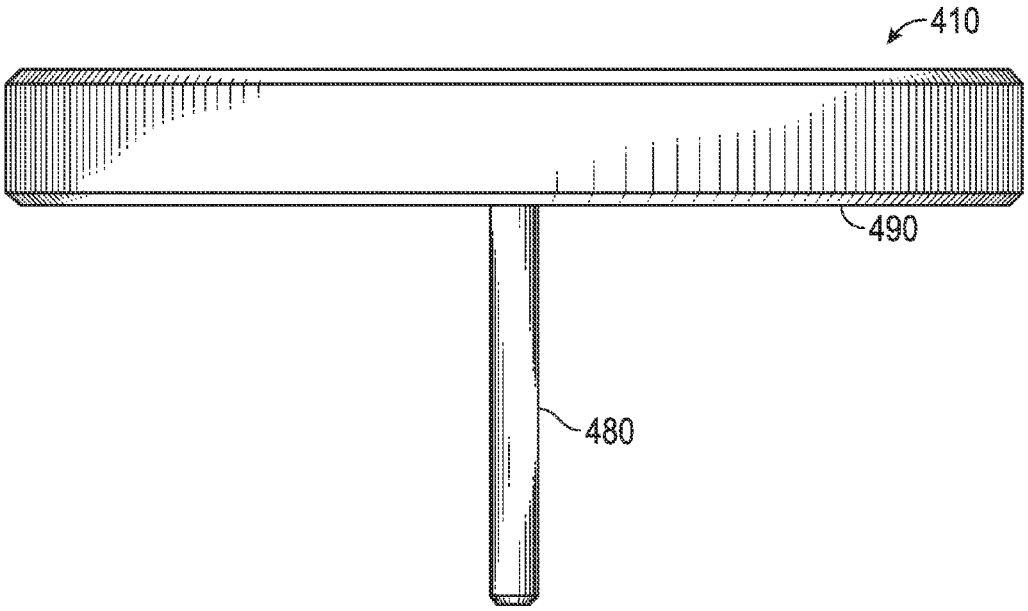
FIG. 25 is a left side elevational view of the circular disc-shaped connector of FIG. 22.
Figure 26:
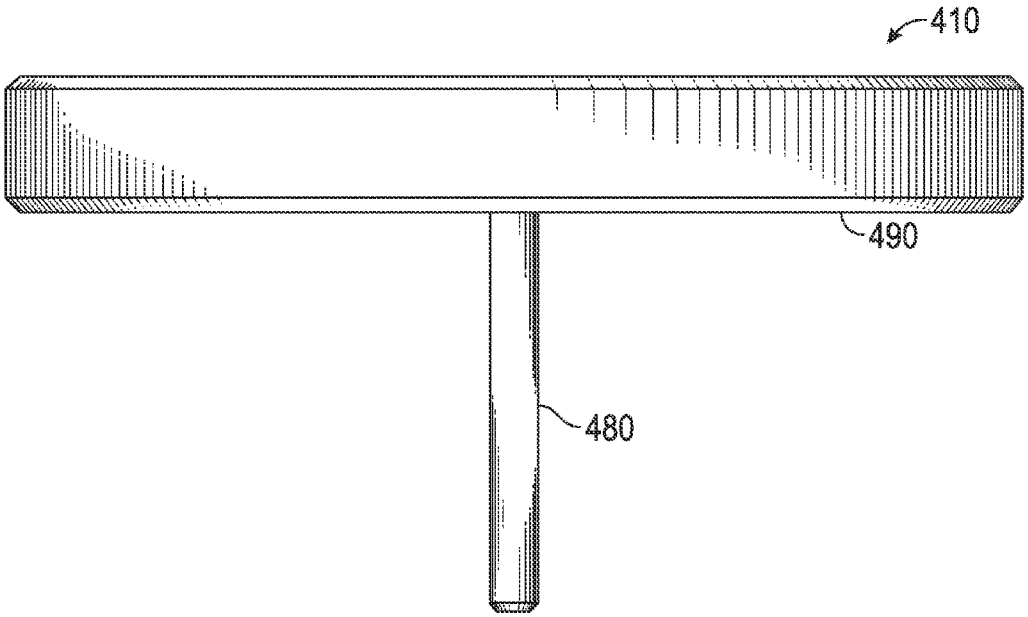
FIG. 26 is a right side elevational view of the circular disc-shaped connector of FIG. 22.
Figure 27:
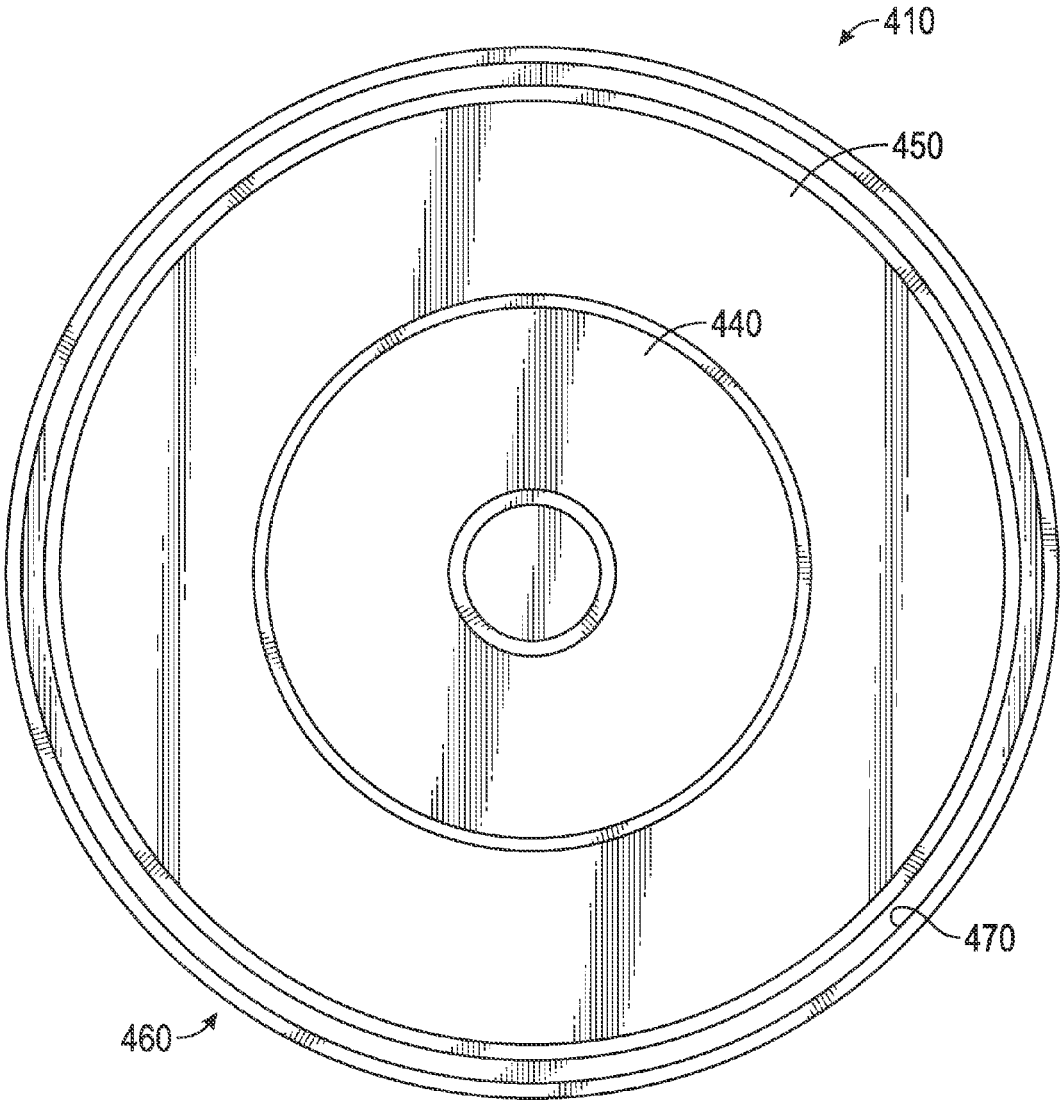
FIG. 27 is a top plan view of the circular disc-shaped connector of FIG. 22.
Figure 28:
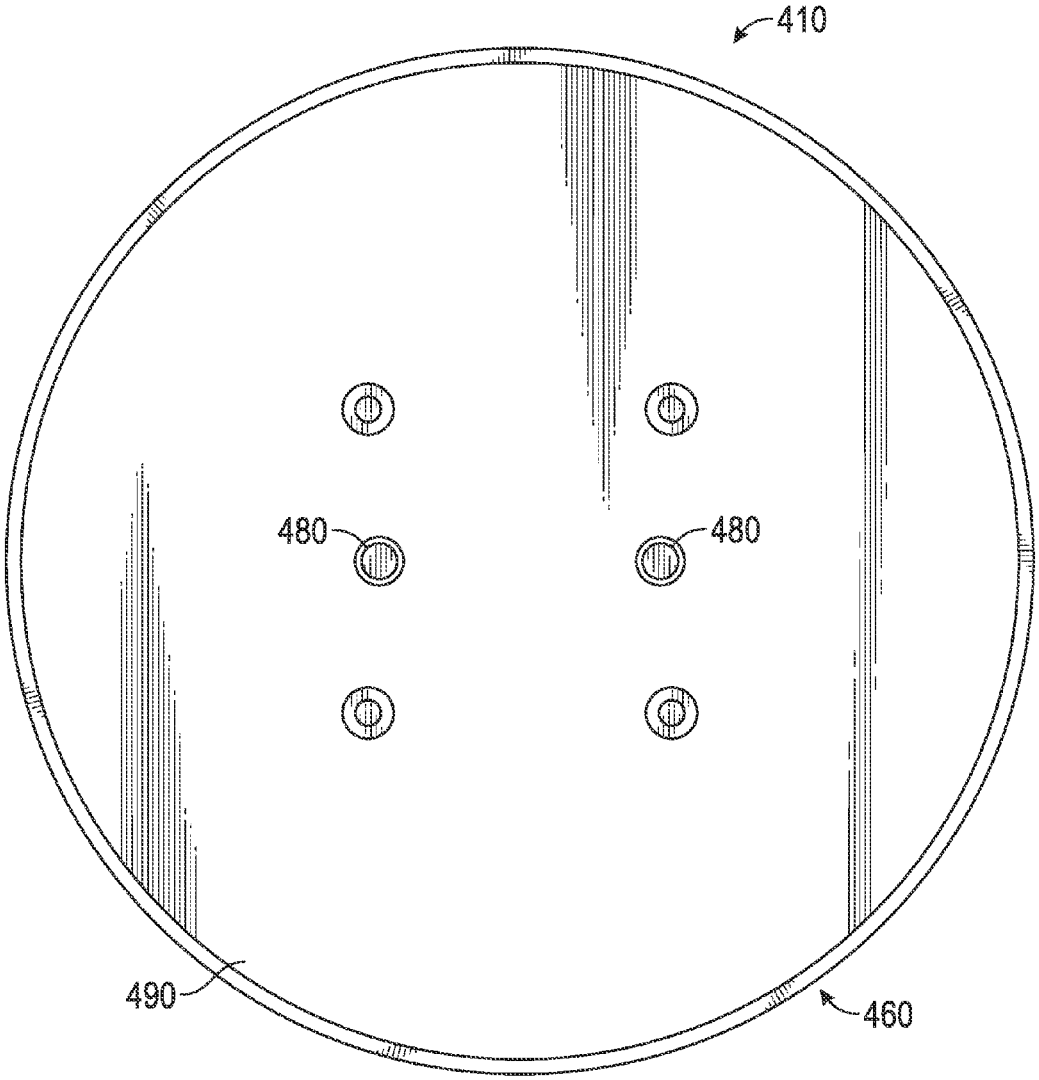
FIG. 28 is a bottom plan view of the circular disc-shaped connector of FIG. 22.
Figure 29:
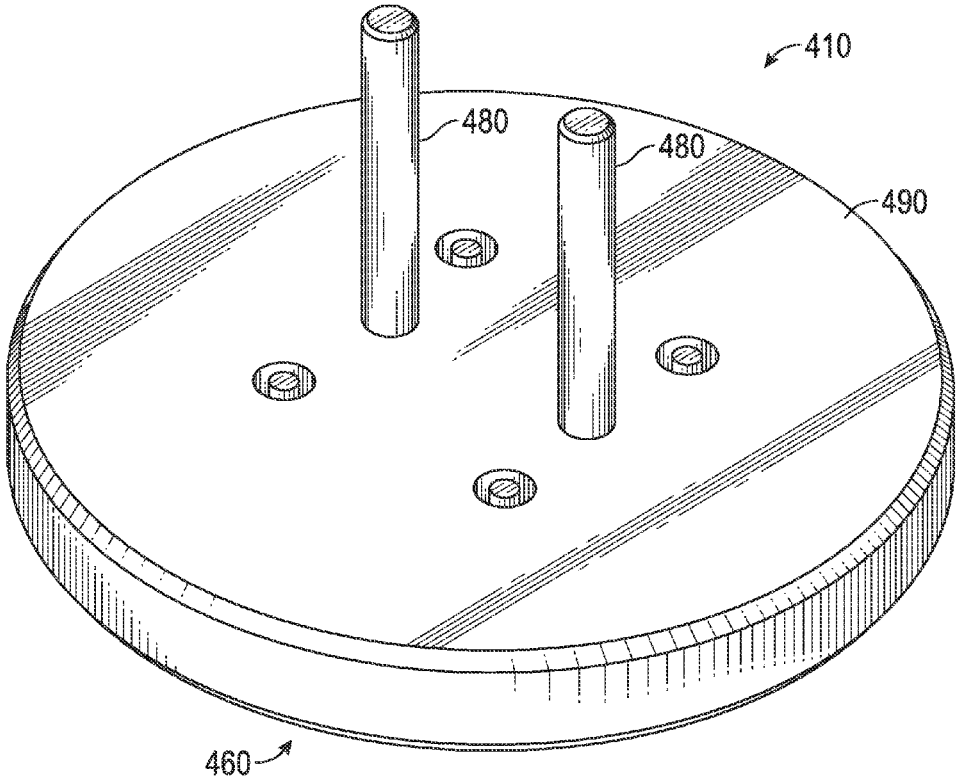
FIG. 29 is a rear perspective view of the circular disc-shaped connector of FIG. 22.
Figure 30:
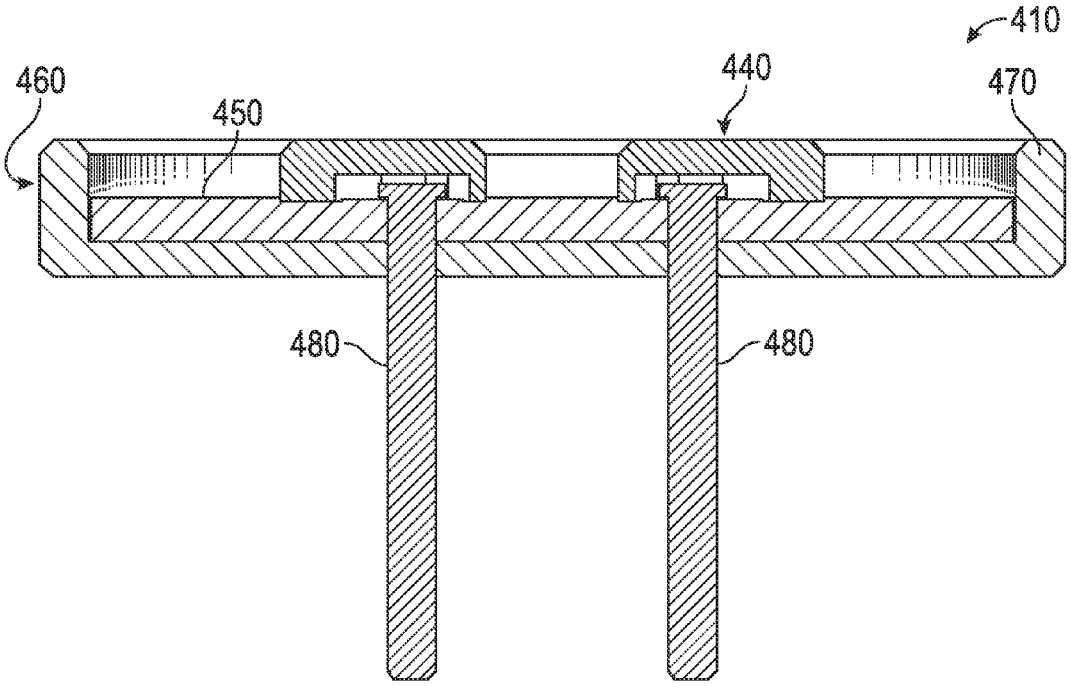
FIG. 30 is a cross-sectional view of the circular disc-shaped connector of FIG. 22.

With reference to FIGS. 12-30, another embodiment of a combination reflector and LED conversion module 400 is shown. Like elements to those shown and described with respect to combination reflector and LED conversion modules 10, 105, 200 are identified with like reference numbers and a "c" suffix, and the description of these elements is incorporated herein. As shown in FIG. 20, the combination reflector and LED conversion module 400 receives a circular disc-shaped connector or connection disc 410 for coupling the combination reflector and LED conversion module 400 to the energy source (e.g., one or more disposable batteries or rechargeable batteries) of flashlight 130*c*. The combination reflector and LED conversion module 400 includes a pair of terminals 420 in base 80*c*. A receiving section 430 extends from the base 80*c*.

The circular disc-shaped connector 410 includes a ring-shaped contact 440 on an upper circular surface 450 of disc member 460. The disc member 460 includes a peripheral circular lip 470. A pair of terminals 480 connected to the ring-shaped contact 440 extend downward from a lower circular surface 490 through holes in the disc member 460.

With reference back to FIG. 20, to convert a non-LED flashlight 130*c* to a LED flashlight 130*c*, an end cap 500 of the non-LED flashlight 130*c* is unscrewed and removed from head housing 495 and the existing non-LED bulb/reflector/base of the non-LED flashlight 130*c* is removed from the head 160*c* of the flashlight 130*c*. The circular disc-shaped connector 410 is inserted in the direction shown into the head 160*c* of the flashlight so that the terminals 480 extend through holes in the head 160*c* and are coupled to the energy source (e.g., one or more disposable batteries or rechargeable batteries) of the flashlight 130*c*. The combination reflector and LED conversion module 400 replaces the existing non-LED bulb/reflector/base. The combination reflector and LED conversion module 400 slides onto the head 160*c* of the flashlight 130*c* so that the receiving section 430 fits over the circular disc-shaped connector 410. When fully inserted, the ring-shaped contact 440 of the circular disc-shaped connector 410 contacts the terminals 420 of the combination reflector and LED conversion module 400. The end cap 500 is then screwed onto the head housing 495 of the head 160*c* to secure the combination reflector and LED conversion module 400 in the head 160*c* of the flashlight.

The addition of the separate circular disc-shaped connector 410 with the combination reflector and LED conversion module 400 makes the installation procedure for the end user as simple and easy as possible. Compared to a combination reflector and LED conversion module 400 where the pin terminals 480 are integrated into and permanently connected to the combination reflector and LED conversion module 400, such a module 400 would make it very difficult to align the pin terminals 480 with the holes in the flashlight head 160*c*. This is because the cooling fins 50*c* hide the pin terminals 480, making it difficult for the end user to try blindly insert these pin terminals 480 into the holes of the flashlight head 160*c*. Another advantage of the circular disc-shaped connector 410 being separate from the module 400 is that it makes it much easier to replace the pin terminals 480 that insert into the holes of the flashlight head socket 160*c* in the event of the end user breaking the pin terminals 480 when trying to force the pin terminals 480 into the holes of the flashlight head 160*c* or in the event of wear and tear on the pin terminals 480 caused by extended use. If the pin terminals 480 were permanently connected to the module 400, the whole module 400 would need replacing whereas with the separate circular disc-shaped connector 410, the lowest cost part of the module 400 is the only piece that will need replacing.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in any claims that follow, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items is present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

What is claimed:

1. A combination reflector and LED conversion module for a non-LED flashlight, comprising:

a cup-shaped reflector including an interior with a reflective surface, an exterior, an open end, and an end opposite the open end;

one or more LEDs carried by the cup-shaped reflector adjacent the end opposite the open end, wherein the combination reflector and LED conversion module replaces an existing non-LED bulb and reflector of a non-LED flashlight to convert the non-LED flashlight to a LED flashlight.

2. The combination reflector and LED conversion module of claim 1, further including a separate connector to couple the one or more LEDs of the combination reflector and LED conversion module to an energy source of the flashlight.

3. The combination reflector and LED conversion module of claim 2, wherein the separate connector includes a circular disc shape.

4. The combination reflector and LED conversion module of claim 3, wherein the separate connector includes an upper circular surface with a ring-shaped contact.

5. The combination reflector and LED conversion module of claim 3, wherein the separate connector includes a lower circular surface with a pair of terminals.

6. The combination reflector and LED conversion module of claim 1, wherein the combination reflector and LED conversion module includes a receiving section that fits over the separate connector.

7. The combination reflector and LED conversion module of claim 1, wherein the exterior of the reflector includes an exterior cooling mechanism for transferring heat away from the one or more LEDs.

8. The combination reflector and LED conversion module of claim 7, wherein the exterior cooling mechanism includes cooling fins that transfer heat away from the reflector.

9. The combination reflector and LED conversion module of claim 8, wherein the exterior cooling fins circumferentially radiate outwardly from the exterior of the reflector.

10. The combination reflector and LED conversion module of claim 8, further including grooves disposed between the exterior cooling fins.

11. A method of converting a non-LED flashlight to a LED flashlight, comprising:

providing a non-LED flashlight including a non-LED bulb and reflector;

removing the non-LED bulb and reflector from the non-LED flashlight;

replacing the non-LED bulb and reflector with the combination reflector and LED conversion module of claim 1 so as to convert the non-LED flashlight to a LED flashlight.

12. The method of claim 11, wherein the exterior of the reflector includes an exterior cooling mechanism, and the method further includes transferring heat away from the one or more LEDs with the exterior cooling mechanism.

13. The method of claim 12, wherein the exterior cooling mechanism includes cooling fins that transfer heat away from the reflector, and the method further includes transferring heat away from the one or more LEDs with the cooling fins.

14. The method of claim 11, further including a separate connector to couple the one or more LEDs of the combination reflector and LED conversion module to an energy source of the flashlight and the combination reflector and LED conversion module including a receiving section that fits over the separate connector, and the method further includes coupling the separate connector to the energy source of the flashlight, fitting the receiving section over the separate connector, and coupling the one or more LEDs to the separate connector.

15. The method of claim 11, where the non-LED flashlight includes an end cap that screws onto and off of a head of the non-LED flashlight, and the method further includes unscrewing the end cap off of the head of the non-LED flashlight prior to removing the non-LED bulb and reflector from the non-LED flashlight and screwing the end cap onto the head of the LED flashlight after replacing the non-LED bulb and reflector with the combination reflector and LED conversion module.

* * * * *